US007182140B2

(12) United States Patent
Wood

(10) Patent No.: US 7,182,140 B2
(45) Date of Patent: Feb. 27, 2007

(54) COILED TUBING/TOP DRIVE RIG AND METHOD

(75) Inventor: Thomas Dyer Wood, Calgary (CA)

(73) Assignee: Xtreme Coil Drilling Corp., Alberta (CA)

( * ) Notice: Subject to any disclaimer, the term of this patent is extended or adjusted under 35 U.S.C. 154(b) by 33 days.

(21) Appl. No.: 11/165,931

(22) Filed: Jun. 24, 2005

(65) Prior Publication Data

US 2006/0289170 A1 Dec. 28, 2006

(51) Int. Cl.
*E21B 19/08* (2006.01)

(52) U.S. Cl. ..... 166/379; 166/77.1; 166/77.3; 166/384; 175/203; 175/220

(58) Field of Classification Search ..... 166/384, 166/385, 379, 77.2, 77.3, 77.1; 175/203, 175/220
See application file for complete search history.

(56) References Cited

U.S. PATENT DOCUMENTS

| | | | | |
|---|---|---|---|---|
| 3,734,209 | A * | 5/1973 | Haisch et al. | 175/57 |
| 3,734,210 | A | 5/1973 | Wilderman | |
| 4,515,220 | A | 5/1985 | Sizer et al. | |
| 4,655,291 | A | 4/1987 | Cox | |
| 5,244,046 | A | 9/1993 | Council et al. | |
| 5,738,173 | A | 4/1998 | Burge et al. | |
| 5,765,643 | A | 6/1998 | Shaaban et al. | |
| 6,003,598 | A | 12/1999 | Andreychuk | |
| RE36,556 | E | 2/2000 | Smith et al. | |
| 6,158,516 | A | 12/2000 | Smith et al. | |
| 6,431,286 | B1 * | 8/2002 | Andreychuk | 166/384 |
| 6,609,565 | B1 | 8/2003 | Andreychuk | |
| 2003/0079883 | A1 * | 5/2003 | McCulloch et al. | 166/379 |
| 2003/0098150 | A1 | 5/2003 | Andreychuk | |
| 2004/0206551 | A1 | 10/2004 | Carriere et al. | |

FOREIGN PATENT DOCUMENTS

| | | |
|---|---|---|
| CA | 2292214 | 6/2001 |
| CA | 2425448 | 2/2005 |

OTHER PUBLICATIONS

Foremost Heavy-Duty Hydraulic Top Drive-Model F-100T, Specification. Quotation to Grey Wolf Drilling, Mar. 15, 2005 6 pages.

* cited by examiner

*Primary Examiner*—Hoang Dang
(74) *Attorney, Agent, or Firm*—Browning Bushman P.C.

(57) ABSTRACT

The rig for selectively inserting coiled tubing or a threaded tubular through a rig floor 13 and into a well includes a mast 15 extending upward from the rig floor and movable between a threaded tubular position and a coiled tubing position. A top drive 21 is movable along an axis of the mast to insert the threaded tubular in the well when a top drive axis 42 is substantially aligned with the axis 44 of the well. Injector 17 supported on the mast inserts coiled tubing into the well, with the injector having an axis 46 offset from the top drive axis and substantially aligned with the axis of the well when the mast is in the coiled tubing position. A powered drive 54 is provided for selectively moving the mast between the threaded tubular position and the coiled tubing position.

39 Claims, 5 Drawing Sheets

COILED TUBING/TOP DRIVE RIG AND METHOD

FIELD OF THE INVENTION

The invention relates to methods and apparatus for performing earth borehole operations, such as drilling, and in particular to methods and apparatus which can use either coiled tubing or threaded pipe.

BACKGROUND OF THE INVENTION

The use of coiled tubing (CT) technology in oil and gas drilling and servicing has become more and more common in the last few years. In CT technology, a continuous pipe wound on a spool is straightened and pushed down a well using a CT injector. CT technology can be used for both drilling and servicing operations.

The advantages offered by the use of CT technology, including economy of time and cost, are well known. As compared with jointed-pipe technology wherein typically 30–45 foot straight sections of pipe are threadedly connected one section at a time, CT technology allows the continuous deployment of pipe, significantly reducing the frequency with which pipe insertion into the well must be suspended to allow additional sections of pipe to be connected. This results in less connection time, and as a result, an efficiency of both cost and time. CT technology also allows fluid to be continuously circulated downhole while inserting the tubular in the well, thereby significantly reducing the likelihood of a stuck tubular.

The adoption of CT technology has been less widespread than originally anticipated as a result of certain problems inherent in using CT. For example, because CT tends to be less robust than threaded pipe, it is often necessary to drill a surface hole using threaded pipe, cement casing into the surface hole, and then switch over to CT drilling. Additionally, when difficult rock formations are encountered downhole, it may be desirable to switch from CT drilling to threaded pipe drilling until drilling through the difficult formation is complete, and then switch back to CT drilling to continue efficiently drilling the well. Similarly, when it is necessary to perform drill stem testing or coring operations to assess conditions downhole, it may again be desirable to switch from CT to threaded pipe and then back again. A switch back to threaded pipe operations may also be desirable to run casing into the drilled well. When conducting CT drilling operations, it is frequently desirable to switch back and forth between a CT drilling rig and a threaded pipe conventional drilling rig, a process which results in significant costs for two rigs and down time as one rig is moved out of the way, and another rig put in place.

A disadvantage of CT drilling is the time-consuming process of assembling a bottom-hole-assembly (BHA)—the components at the end of the CT for drilling, testing, well servicing, etc., and connecting the BHA to the end of the CT. Presently, this operation is commonly performed manually through the use of rotary tables and make-up/breakout equipment. In some instances, top drives are used, but one of the CT injector or the top drive must be moved out, i.e., they cannot both be in line with the borehole. Not only does this process result in costly downtime, but it can also present safety hazards to the workers as they manipulate heavy components manually.

U.S. Publication 2004/0206551 discloses a rig adapted to perform earth borehole operations using both CT and/or threaded pipe, the CT injector and a top drive being mounted on the same mast. The CT injector is selectively moveable with respect to the mast between a first position wherein the CT injector is in line with the mast of the rig and hence the earth borehole and a second position wherein the CT injector is out of line with the mast to allow threaded pipe operations using the top drive.

The disadvantages of the prior art are overcome by the present invention, and an improved rig and method for selectively inserting either coiled tubing or a threaded tubular into a well utilizing a coiled tubing injector or a top drive, respectively, is hereinafter disclosed.

SUMMARY OF THE INVENTION

In one aspect, the present invention provides a rig for selectively inserting coiled tubing or a threaded tubular through a rig floor and into a well. The rig includes a mast extending upward from the rig floor and movable between a threaded tubular position and a coiled tubing position. A top drive is movable along an axis of the mast to insert the threaded tubular into the well, with a top drive having a top drive axis substantially aligned with an axis of the well when the mast is in the threaded tubular position. An injector supported on the mast is also provided to insert the coiled tubing into the well, with the injector having an injector axis offset from the top drive axis and substantially aligned with the axis of the well when the mast is in the coiled tubing position. A powered drive is used to selectively move the mast between the threaded tubular position and the coiled tubing position.

In another aspect of the invention, the mast is pivotally movable with respect to the rig floor between a threaded tubular position and a coiled tubing position. An injector may be secured to the mast by a support bracket, or a slide supported on the mast may be provided for guiding vertical movement of the injector relative to the rig floor when the mast is in the coiled tubing position.

Further features and advantages of the present invention will become apparent from the following detailed description, wherein reference is made to the figures in the accompanying drawings.

DESCRIPTION OF THE PREFERRED EMBODIMENTS

Figure 1:
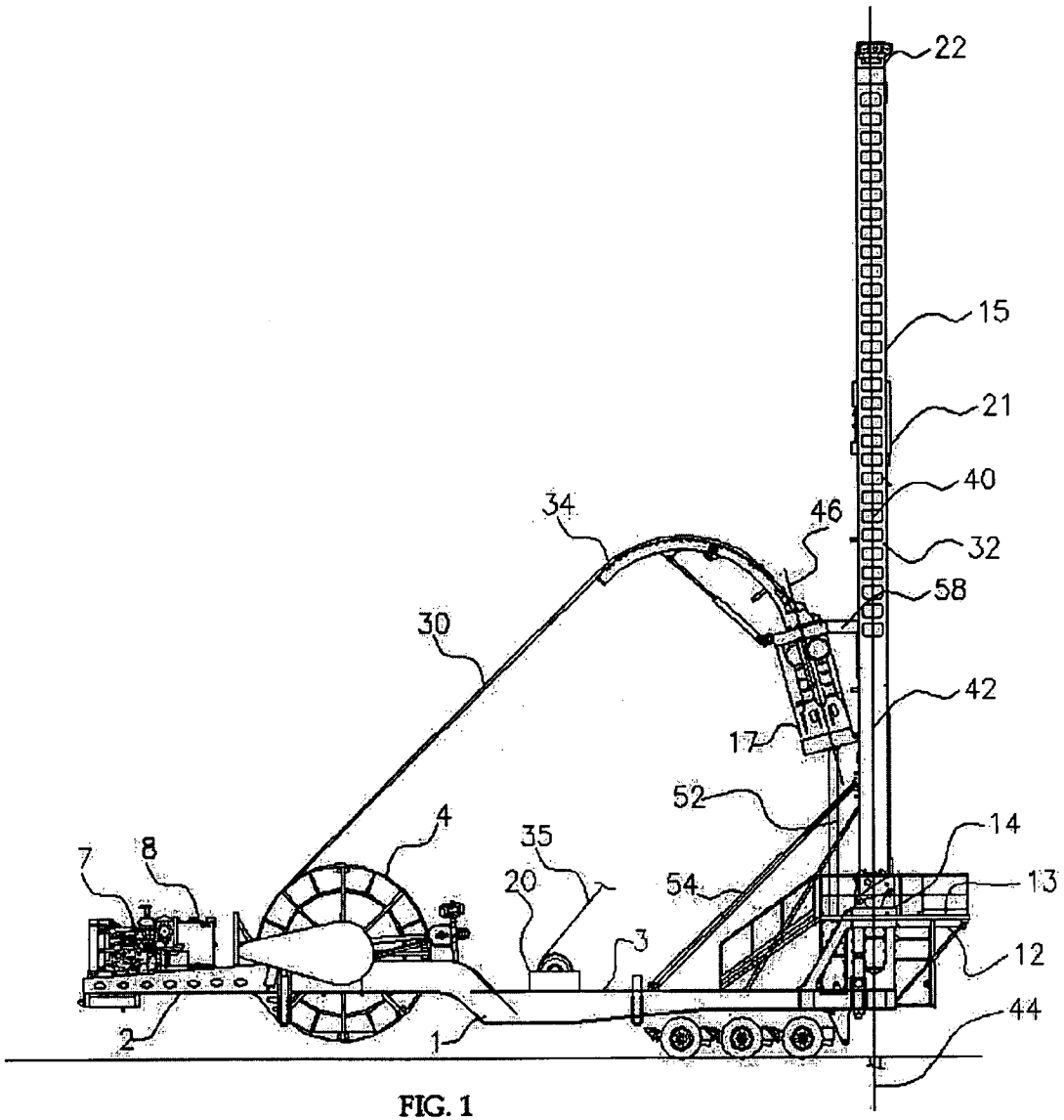
FIG. 1 is a side elevational view of one embodiment of the present invention including a top drive supported on a mast and aligned with a wellbore.

Referring to FIG. 1, one embodiment of the rig includes a mast 15, a working platform 12, and a rig floor 13. Mast 15 is comprised of a pair of spaced elongate frame members 32 interconnected at the top by a crown 22. Mast 15 is pivotally connected to platform 12, as described below. As shown in FIG. 1, the platform 12 is supported on a wheeled carrier or trailer 1 having a relatively low carrier surface 3. The wheeled carrier 1 may also include a tongue 2 which may be attached to a motorized vehicle, such that the trailer 1 may be moved from one location to another. It will be appreciated that the wheeled carrier 1 may alternatively be self propelled, or that the carrier may comprise a stationary structure as, for example, a skid or the like which can be raised and placed on a trailer or other transport vehicle for movement to another site. It will also be appreciated that the rig of the present invention could be mounted on an offshore platform via a skid or other substructure on which the mast and other components are mounted. Wheeled trailer 1 also provides a second, rear platform on which a rotary table 14 is provided, with rig floor 13 defined by platform 12. Working platform 12, which preferably may be raised above carrier 1, provides a rig floor 13 for workers to manipulate various downhole components into and out of the rotary table 14 on the working platform, and enables workers to perform other normal operations in conjunction with earth borehole operations such as drilling, workover, servicing, etc.

Rotatably mounted on the trailer 1 is a spool 4 upon which is wound a length of coiled tubing 30. Spool 4 can be rotated in a clockwise and counterclockwise directions using a suitable drive assembly (not shown). Also located on trailer 1 is an engine 7 and a hydraulic tank 8 for storage of hydraulic fluid used in operating the various hydraulic components of the rig, e.g., motors, hydraulic cylinders, etc. As is well known, most of the components of the rig may be operated hydraulically, electrically or, in some cases, pneumatically. Coiled tubing 30 extends up to a gooseneck or guide 34. The gooseneck 34 is attached to the top of coiled tubing injector 17 which, as shown in FIG. 1, is spaced from the mast 15. Coiled tubing injector 17 typically comprises a series of blocks, sprockets or like grippers driven by endless chains or belts which grab the coiled tubing 30 and force it downwardly when it is being injected into a well and pull it upwardly when it is being removed from the well.

As shown in FIG. 1, a top drive 21 is mounted on mast 15 between members 32 for longitudinal movement therealong in either direction. Typically, top drive 21 is mounted on a track system, which is affixed to members 32, with the track system defining a central mast axis 40 which defines the direction of travel of the top drive 21. Top drive 21 may be moved longitudinally along mast 15 by a hoisting system comprised of a winch or draw works 20 mounted on trailer 1 and one or more cables 35 which run through a sheave assembly in crown block 22 located at the top of mast 15. The cables 35 may extend down from the crown block and be attached to top drive 21, whereby draw works 20 may selectively raise top drive 21 upwardly along mast 15 or lower top drive 21 downwardly along mast 15. It will also be appreciated that provision could be made to use a screw mechanism extending longitudinally along members 15 to selectively raise or lower top drive 21 along mast 15. It will be recognized, however, that top drive 21 could be moved by hydraulic cylinders or other powered drive member to selectively position the top drive longitudinally along mast 15. In the embodiment shown in FIG. 1, a central axis 42 of the top drive 21 is thus in line with the axis 40 of the mast 15 and the axis 44 of the borehole or well, while the coiled tubing injector 17 has its axis 46 offset from the top drive axis 42. The coiled tubing injector 17 may be positioned above or below top drive 21, but the centerline of the top drive 21 is spaced from the centerline of the coiled tubing injector 17.

For the embodiment shown in FIG. 1, the axes of both top drive 21 and mast 15 are always out of alignment with the axis 46 of the coiled tubing injector 17, such that the top drive and the injector may work independently. It will be appreciated that coiled tubing injector 17 is out of alignment with the axis 42 of top drive 21, and that the axis 42 of top drive 21 is in line with axis of the mast 15 and the wellbore. The threaded tubulars supported on the top drive 21 may thus be passed into the well while the injector 17 is inoperative.

Figure 2:
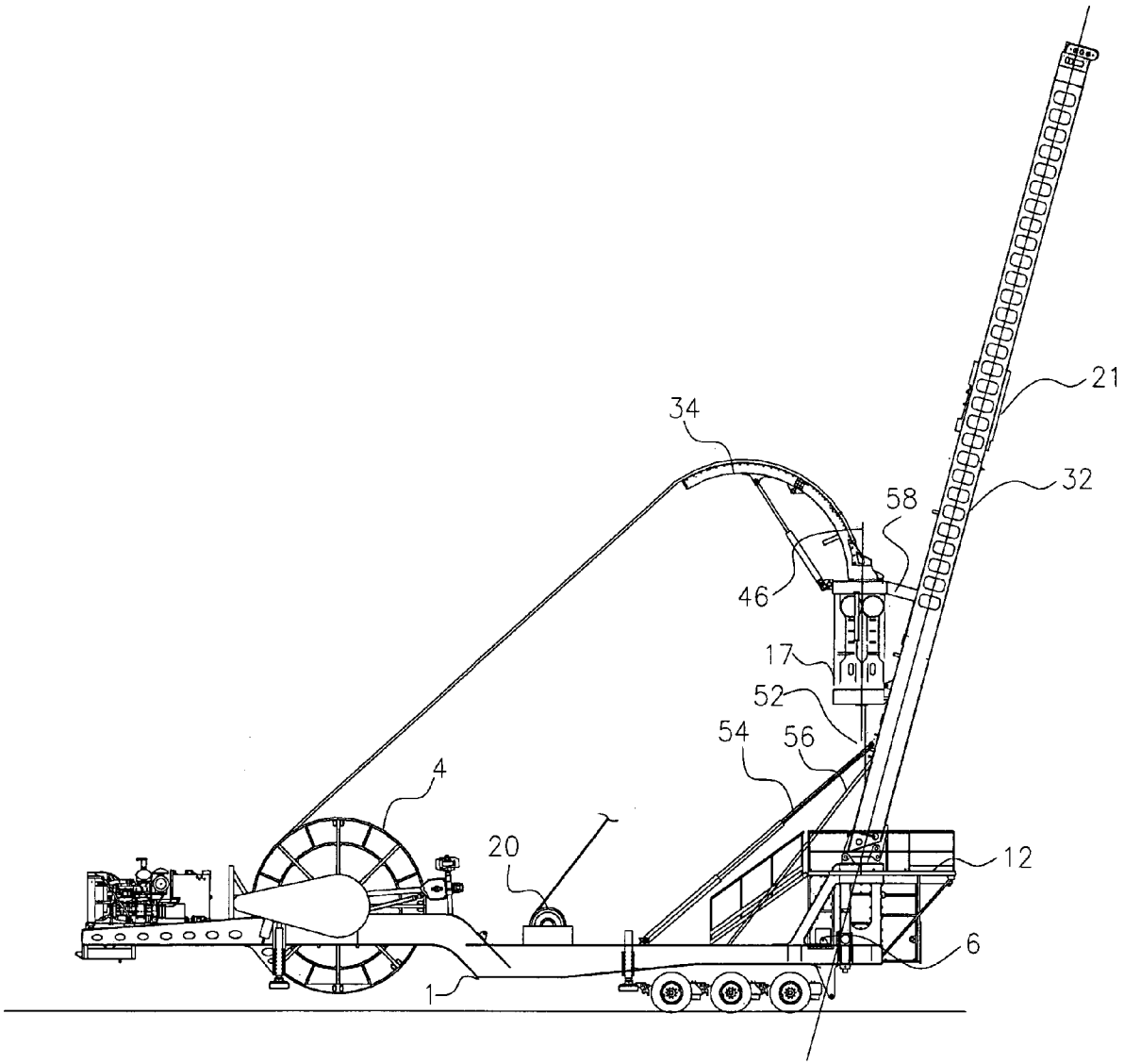
FIG. 2 illustrates the rig as shown in FIG. 1, with the mast moved to the coiled tubing position so that the centerline of the injector is aligned with the wellbore.

Particularly for embodiments wherein the reel 4 is supported on the carrier 1, the injector 17 and thus the guide 34 are provided between the mast 15 and the reel 4, so that the mast does not interfere with coiled tubing operations when in the FIG. 2 configuration, and the injector does not interfere with the top drive and threaded tubular operations when in the FIG. 1 configuration.

In FIG. 1, the coiled tubing injector 17 is thus in an inoperative position while the top drive 21 is in position to manipulate threaded tubular components. With coiled tubing injector 17 out of alignment with the axis 44 of the wellbore, the top drive 21 may perform operations typically performed by a top drive such as, for example, manipulating a tubular component such as casing brought in through the V-door, as is common in typical oilfield operations. Although not shown, it will be appreciated that the rig of the present invention may be provided with elevators and other components normally used to manipulate downhole components, e.g., to grip a pipe or other downhole component and move it to a position where it may be engaged and subsequently manipulated by the top drive. This ability to selectively use the top drive and the injector independently of one another is clearly advantageous in terms of saving cost and time. The rig is universal in the sense that the same rig carries a coiled tubing injector to manipulate coiled tubing and a top drive to manipulate jointed pipe or other downhole components. The injector and the top drive are selectively, independently operable to perform their customary functions.

Turning now to FIG. 2, the coiled tubing injector 17 is positioned over the axis 44 of well while the axis of both the mast 15 and top drive 21 are out of alignment with wellbore axis 44, and the top drive 21 is not operable. Thus, for the embodiment shown in FIG. 2, the coiled tubing injector 17 is being used to manipulate coiled tubing 30 and the top drive 21 is in an inoperative position, while for the embodiment shown in FIG. 1, the top drive 21 is used to inject threaded tubulars into the well, and the injector 17 is inoperative.

FIG. 2 also depicts a lubricator 52 positioned below the injector 17 for sealing an annulus about the injected tubular as it is run into and out of the well. One or more hydraulic cylinders 54 extending between the mast 15 and the trailer 1 may be provided for pivoting the mast 15 between the coiled tubing injector position as shown in FIG. 2 and the top drive position as shown in FIG. 1. An extendable member 56 may serve as a stop to limit pivoting action of the mast 15 when the mast is in the coiled tubing injector position. Alternatively, other stops and/or limit switches may be positioned on the platform 12 or the mast 15 to serve the function of either a stop or to discontinue power to the cylinders 54 to stop the mast when it is in either the position shown in FIG. 1 or the position as shown in FIG. 2. In another embodiment, the lubricator may be provided in and above the platform 12, but does not extend upward to engage the injector. FIG. 2 also depicts a coiled tubing cutting unit 6 which may be positioned on the rig floor 3 for severing the coiled tubing at a selected location above the rotary table, while still supporting the severed coiled tubing within the well.

FIG. 2 also depicts a support bracket 58 secured to the mast 15 and to the injector 17 for fixing the relative position of the injector with respect to the mast. The axis 46 of the injector is thus angled with respect to the axis 40 of the mast 15, so that when the mast 15 is tilted as shown in FIG. 2, the axis of the injector is vertical, so that coiled tubing may pass through the injector and into the wellbore. A plurality of latching or locking mechanisms may be spaced longitudinally along mast 15 such that the top drive 21 may be held at a variety of desired, longitudinally spaced locations along mast 15 when the injector 17 is operative.

Referring to FIGS. 1 and 2, it should be understood that the angle between the axis 44 of the injector 17 and the axis 42 of the top drive 21 is the same as the angle of the mast 15 from vertical, so that the mast 15 when vertical will have the axis 42 of the top drive 21 aligned with the well, and the mast 15 when inclined will have the axis 42 of the injector aligned with the same axis of the well.

A universal rig is provided which can selectively handle and run different types of pipe, coiled tubing, and other earth borehole equipment, thereby eliminating the need for two rigs—one rig to use a top drive in the conventional manner with threaded tubulars, and a separate coiled tubing injector rig to perform coiled tubing operations.

Figure 3:
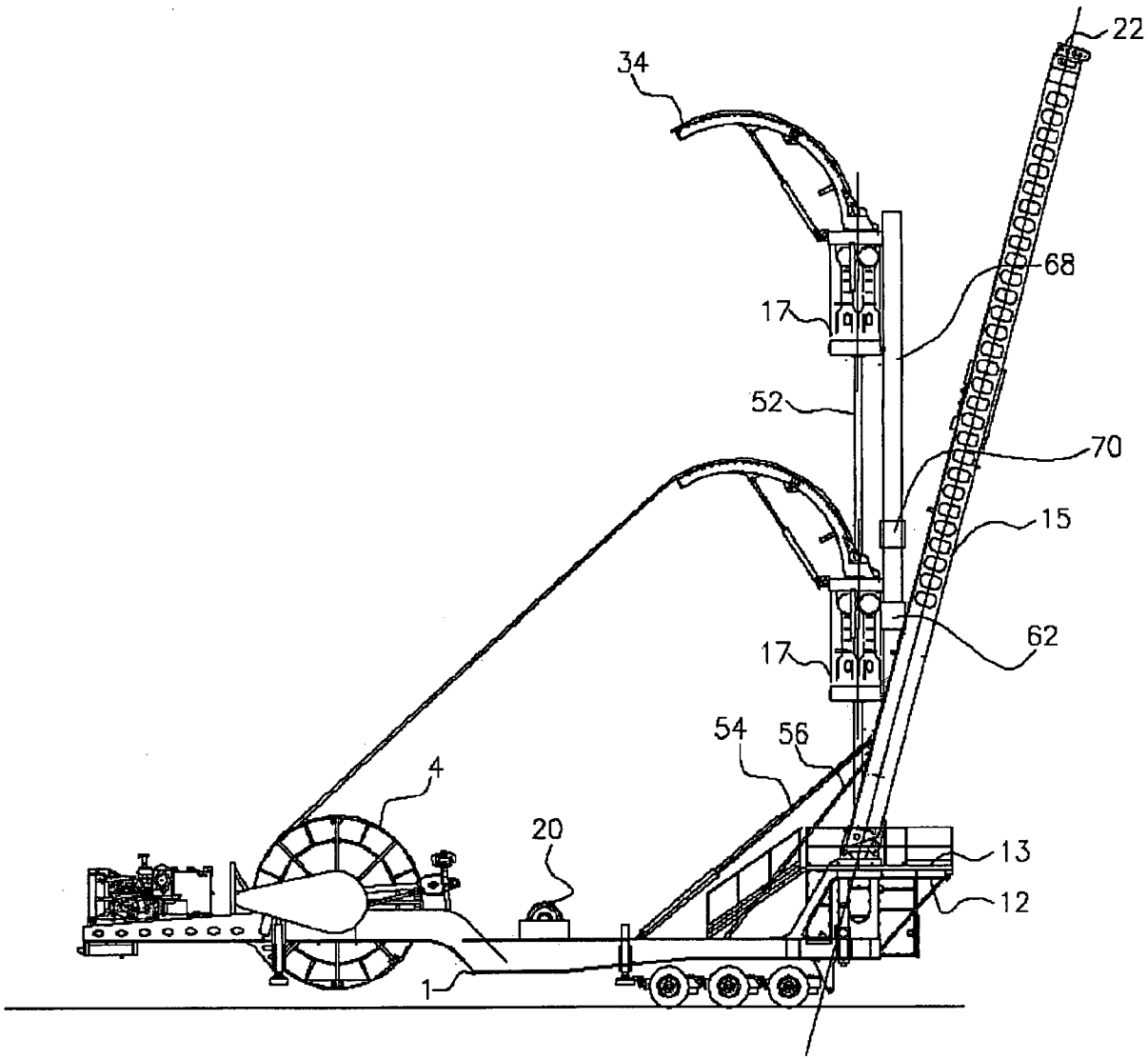
FIG. 3 is a side elevational view of another rig according to the invention, and the centerline of the injector aligned with the wellbore and the injector vertically movable along a slide supported on the mast.

For the embodiments described subsequently, the same numerals are used to reference similar components. Referring to FIG. 3, a mast 15 is pivotal with respect to the platform 12, but in this case the injector 17 is not fixed to the mast, and instead a vertical slide member 68 is fixed to the mast, with the axis of the slide member being vertical when the mast is in the coiled tubing position as shown in FIG. 3. The mechanical connection between the vertical slide 68 and the mast does not interfere with the travel of the top drive 21 along the mast, but does allow the injector 17 and the guide 34 on top of the injector to be lowered and raised with respect to the mast, as shown in FIG. 3. This feature allows the injector to be positioned desirably close to the rig floor 13 when injecting coiled tubing into the well, but also allows the injector 17 to be elevated to a higher position so that relatively long tools can be positioned between the injector and the rig floor during service operations. Also, those skilled in the art appreciate that the mast 15 may be pivoted to a travel position so that the crown block 22 is closely adjacent the front of the trailer 1. The slide member 68 allows the injector to be moved to a selected location along the mast when lowering the mast to a position for travel of the rig to another location.

In FIG. 3, the bracket 62 secured to the injector 17 is thus slidable along the axial length of the slide member 68, and this movement may be controlled by a winch mechanism, by cylinders, by a chain drive mechanism powered by a hydraulic motor, or by other suitable drive mechanism 70 for raising and lowering the injector. Except as discussed herein, the other components of the rigs shown in FIGS. 3–6 may be similar to the FIGS. 1 and 2 rig components.

Figure 5:
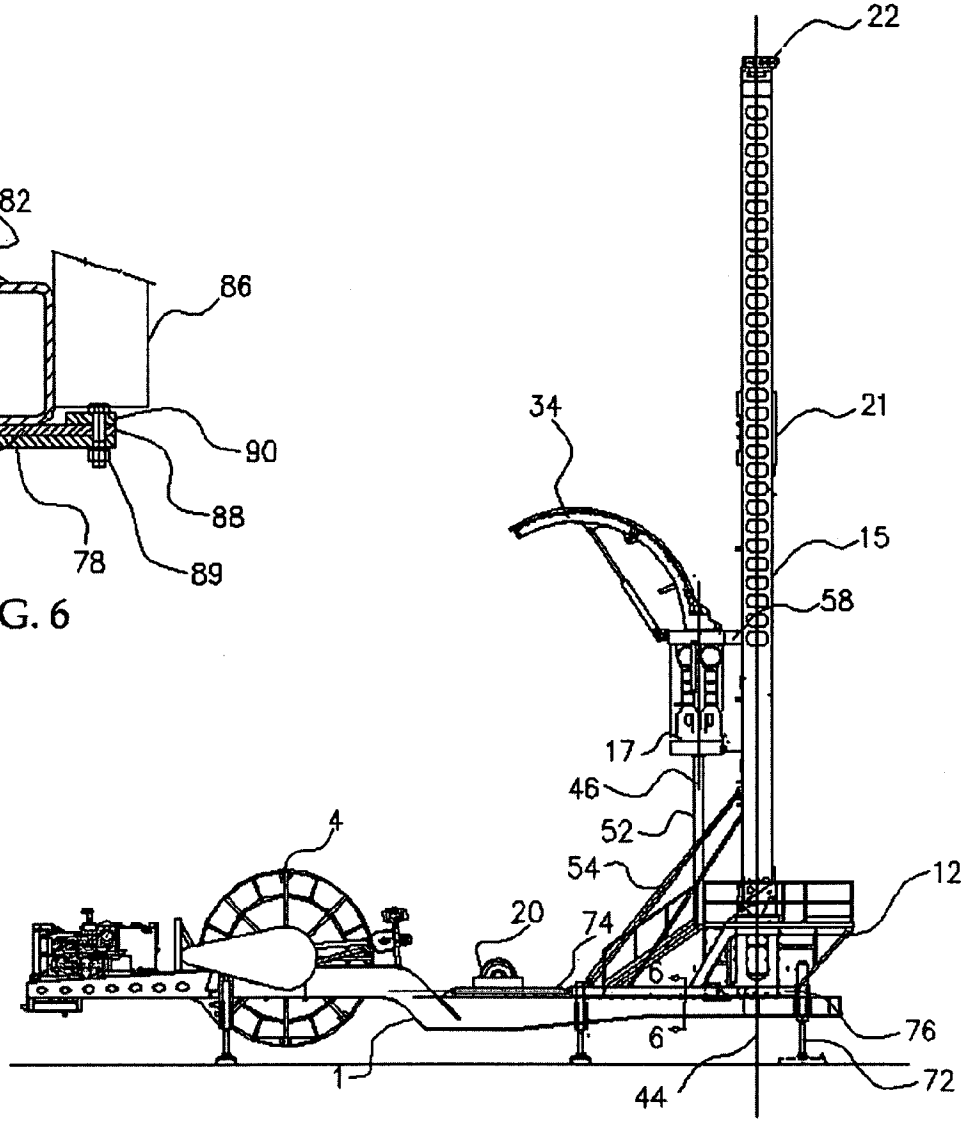
FIG. 5 illustrates the rig as shown in FIG. 4, with the mast moved laterally so that the centerline of the injector is aligned with the centerline of the wellbore.

Referring now to FIG. 5, the mast 15 and the top drive 21 are positioned in line with the centerline 44 of the well, so that the rig may be used for operations involving tubular joints with threaded ends. The axis 46 of the injector 17 is spaced from the axis 40 of the mast 15, but these axes are parallel rather than being inclined. Bracket 58 may thus fix the position of the injector 17 on the mast.

Figure 4:
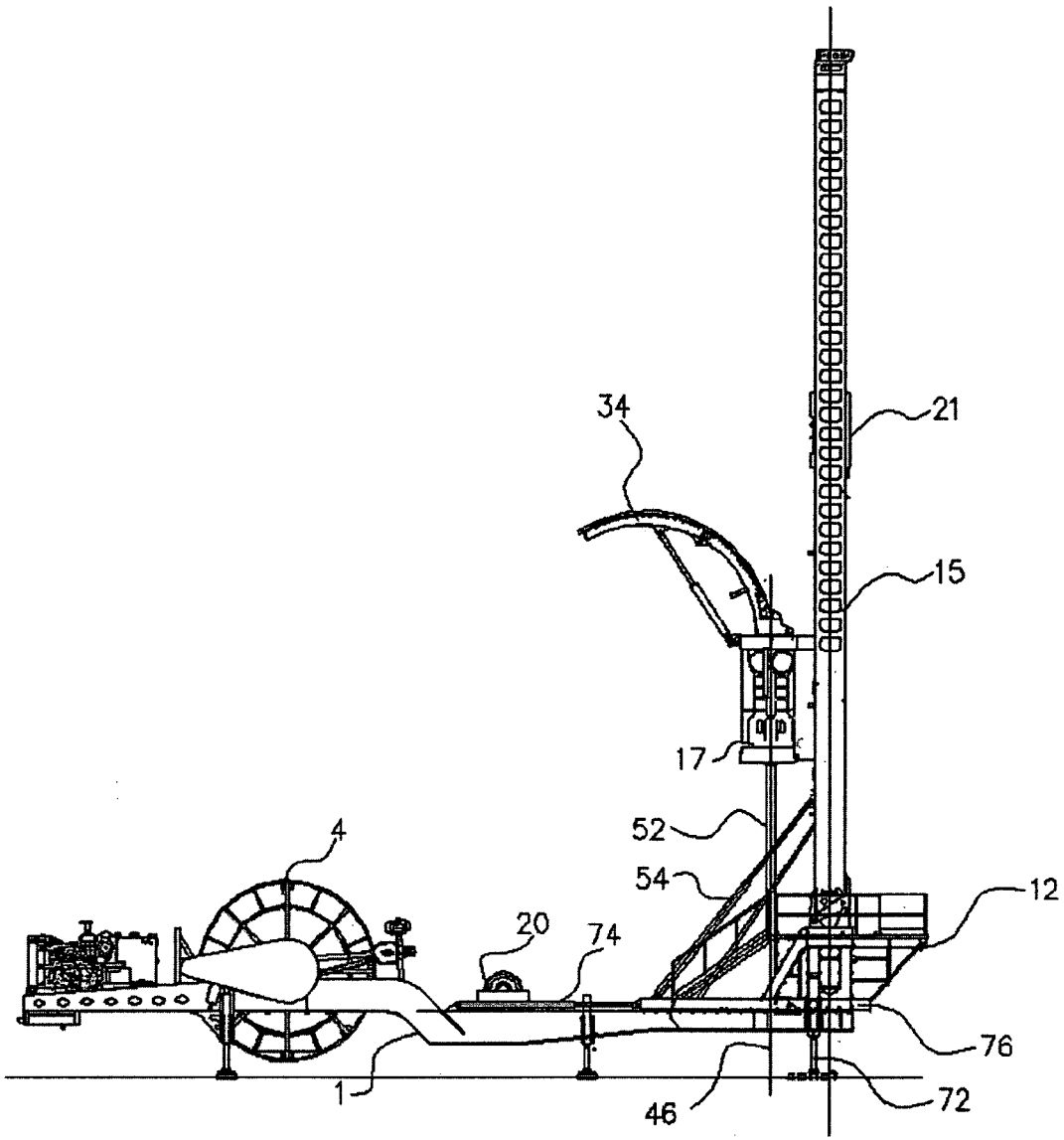
FIG. 4 illustrates another embodiment of the invention, with the top drive supported on a mast and aligned with the wellbore.
Figure 6:
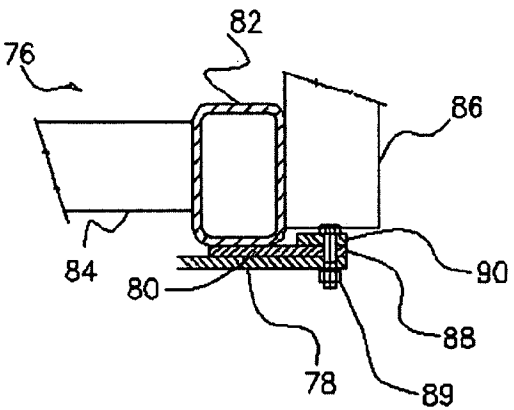
FIG. 6 is a cross section along lines 6—6 in the FIG. 5, showing further details of the mast positioning mechanism.

Rather than pivot the mast, the embodiment as shown in FIGS. 4 and 5 moves the platform 12 and the mast 15 relative to the trailer 1 in a lateral direction, so that the centerline 46 of the injector 17 may be positioned in line with the wellbore, as shown in FIG. 4. Guide rails 78, 88 and 90 as shown in FIG. 6 and one or more hydraulic cylinders 74 as shown in FIGS. 4 and 5 may be used to laterally move the platform 12 and the mast 15 with respect to the trailer 1 between the top drive position as shown in FIG. 5 and the tubing injector position as shown in FIG. 4. When not in use, the mast 15 may still be pivoted so that the mast may be lowered to a position generally over the trailer when transporting the rig to another well site. FIGS. 4 and 5 also depict a plurality of ground engaging telescopic members 72 for reliably supporting the trailer 1 and the equipment supported thereon when the rig is in use and when the mast is being moved laterally between the top drive position and the tubing injector position. The same ground engaging member may be used for the other embodiments described herein.

FIGS. 4 and 5 depict one or more hydraulic cylinders 74 for moving the platform 12 and the mast 15 laterally between the coiled tubing position and the top drive position. More particularly, the rod end of the cylinder 74 is connected to base frame 76 which slides on a top plate 78 of the trailer 1, as shown in FIG. 6. Slide plate 80, rectangular frame member 82, support member 84 and support member 86 thus move as an assembly relative to the trailer. Guide plate 88 may be secured by the bolt and nut assembly 89 between the top trailer plate 78 and the cap plate 90, with the plates 88 and 90 acting as a guide during lateral travel of the frame 76 between the tubing injector position and the top drive position. A similar guide on the opposing side of the base frame 76 provides reliable movement between the two positions. Other types of guide rails may be provided. In the FIG. 4 and 5 embodiments, the stop member 56 may be eliminated, or may be used to stop pivoting movement of the mast when moved to the travel position.

In an alternate embodiment, a slide member 68 similar to that shown in FIG. 3 may be used in the FIGS. 4 and 5 embodiments, thereby allowing the injector 17 to move vertically with respect to the mast. The slide member would, however, preferably not have an axis inclined relative to the axis of the mast, but rather would have an axis parallel to and offset from the axis of the mast. The slide member could then be used to raise or lower the injector 17 when the mast was in the coiled tubing position, as shown in FIG. 4.

For the embodiments discussed above, the mast 15 had a vertical axis when the rig is being used with the top drive to run threaded tubulars in the well, and the axis of the mast is tilted off-vertical or is moved laterally from the vertical axis of the injector 17 when performing coiled tubing operations. It should be understood that, in other applications, the axis of the mast, the top drive, and the rotary table may each be inclined from vertical, but these axes remain aligned with the axis of the borehole, which is also inclined. If the borehole were drilled so that the mast 15 was inclined 10° to the right as shown in FIG. 1, the mast may be further inclined, e.g., to 28° from vertical, when performing coiled tubing operations, since the axis of the injector 17 will be aligned 15° off-vertical at this time so that the coiled tubing remains aligned with the axis of the borehole. Tilting of a mast 15 from vertical is frequently done when performing certain types of directional or slant drilling operations, including drilling a borehole under a river bed.

For the embodiment as shown in FIGS. 1 and 2, the injector 17 is preferably fixedly secured to the mast 15 by the support plate 58 during coiled tubing operations, threaded tubular operations, for switching from one operation to another operation. Similarly in FIG. 3, injector 17 is secured to the slide 68 in a manner which allows vertical movement of the injector, but otherwise restricts movement of the injector relative to the slide 68. While it is preferable that the injector 17 be fixed to the mast 15 for operating in the FIG. 1 or FIG. 2 configurations, it is also preferable that the injector 17 be pivotable with respect to bracket 58 when the mast is laid down for transport of the rig. Mast 15 as shown in FIG. 1 may thus pivot in a counterclockwise direction, with the final travel position of the mast being substantially horizontal and between the hubs of the reel 4. When laying down or raising the mast 15, coiled tubing 30 on the reel 4 continues to be held in the injector 17 to counteract forces exerted on the coiled tubing by the reel 4. During this operation of preparing the rig for transport, the axis of the injector 17 preferably may pivot with respect to the bracket 58 to minimize bending forces on the coiled tubing and forces on the injector. When laying down the mast, a pin or other catch mechanism may thus be pulled to allow pivoting of the injector 17 relative to the bracket 58, and thereafter the injector 17 may pivot about axis 92, as shown in FIG. 2. When the mast is raised at a new well site for performing oilfield operations, the pin may be reinserted or the lock mechanism activated to again fix the injector 17 relative to the mast 58. In the FIG. 3 embodiment, it is also preferable that the fixed position of the slide 68 relative to the mast be released when laying down the mast for transport, allowing the slide 68 to pivot when preparing for transport relative to the mast 15. When the mast is raised to the activated position, the pin may be inserted or the lock mechanism activated so that the slide 68 is fixed to the mast 15. In the FIG. 3 embodiment, the injector 17 may also be allowed to pivot with respect to bracket 62. The ability of the injector to pivot with respect to the mast when laying the mast down for transport and when raising the mast at the new well may also be utilized for the embodiment as shown in FIGS. 4 and 5. The benefits of allowing selective tilting of the injector relative to the mast is particularly important, however, for embodiments wherein the mast is pivoted between the coiled tubing position and the threaded tubular position.

The rig as disclosed herein may be used to accomplish numerous different earth borehole operations. In the case of employing the coiled tubing injector, the rig may be used to drill using downhole mud motors, such drilling being both directional and straight hole. Additionally, coiled tubing may be used in various completion operations, such as fracturing, acidizing, cleanouts, fishing operations, using coiled tubing as a velocity string, etc. The coiled tubing can also be run as a production tubing. With respect to typical top drive operations, conventional drilling can be done, casing can be run, and completion and well servicing operations as described above with respect of coiled tubing can also be accomplished. Additionally, the top drive can be used to run conventional production tubing.

Circulation of fluid through the coiled tubing string occurs during drilling and preferably during insertion of the coiled tubing into the well, with the circulating fluid flowing between the interior of the tubing string and the annulus about the tubing string. Circulation when installing a tubing string is preferable in order to better convey the string into the well and to provide proper hole cleaning.

For many applications, the coiled tubing once installed in the well provides a barrier between the annulus about the tubing and the interior of the tubing. In other embodiments, the coiled tubing is not a solid tubular, and instead may be slotted or perforated to allow fluid to flow into the interior of the casing string.

The coiled tubing may be made from various materials, including a carbon alloy steel or a carbon fiber material. Various types of guide devices, cementing stage tools, driver shoes, packers, perforating guns, correlation indicators, and cross-over tools may be used in conjunction with the coiled tubing string.

The coiled tubing may be conveyed into a wellbore vertically, directionally, or in a substantially horizontal plane. Applied internal pressure within the coiled tubing may be produced with an energized fluid or gas. Air, nitrogen, natural gas, water, compatible liquid hydrocarbons, drilling muds, and other mediums may be used for pumping into the coiled tubing string utilizing pumps or compressors common in the oilfield industry.

The word "carrier" as used herein is intended to mean any structure, be it portable or fixed, whether on land or offshore, to which the mast can be pivotally or slidably attached, which will support the mast and the attendant equipment used in the rig.

The above discussion referred to centerlines of the mast, the top drive, the injector, and the borehole, frequently referencing certain axes as being aligned or out of alignment at different times. It should be understood that when reference is made to the axes of equipment being in alignment, exact or precise alignment of the equipment axes is not required. Rather, it should be understood that the axes of equipment which are aligned are substantially in alignment, and any misalignment creates no significant problems with respect to the passage of the tubulars between the equipment or the borehole.

The term "injector" as used herein is meant to refer to any powered equipment for moving coiled tubing into or out of a well. Conventional injectors were discussed above and are well known in the art, but other types of injectors use different techniques for moving coiled tubing into and out of the well. All equipment of the type supportable on a mast for moving the coiled tubing into and out of a well are thus considered to be an injector. Similarly, the term "top drive" as used herein refers to any drive mechanism positioned above the rig floor for rotating a threaded tubular. The top drive is movable along the axis of the mast, as disclosed herein, to insert the threaded tubular into the well, and various types of top drives may be provided with a suitable mechanism for moving the top drive along the mast.

It will be understood, that the present invention is not limited to the use in oilfield operations but can be used in water well drilling, mining operations, in drilling injection wells, etc. Also, as noted above, the apparatus of the present invention is not limited to land earth borehole operations but can be used, as well, on offshore drilling and production platforms.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A rig for selectively inserting coiled tubing or a threaded tubular through a rig floor and into a well, the rig comprising:

a mast extending upward from the rig floor and movable between a threaded tubular position and a coiled tubing position;

a top drive movable along an axis of the mast to insert the threaded tubular in the well, the top drive having a top drive axis substantially aligned with an axis of the well when the mast is in the threaded tubular position;

an injector supported on the mast to insert the coiled tubing into the well, the injector having an injector axis offset from the top drive axis and substantially aligned with the axis of the well when the mast is in the coiled tubing position; and a powered drive for selectively moving the mast between the threaded tubular position and the coiled tubing position.

2. A rig as defined in claim 1, further comprising:

a coiled tubing guide above the injector for guiding the coiled tubing from a reel into the injector.

3. A rig as defined in claim 1, further comprising:

a lubricator extending downward from the injector for sealing an annulus about the coiled tubing.

4. A rig as defined in claim 1, wherein the mast is mounted on a wheeled carrier.

5. A rig as defined in claim 1, further comprising:

draw works for moving the top drive along the axis of the mast.

6. A rig as defined in claim 1, further comprising:

a guide rail for guiding lateral movement of the mast with respect to the rig floor between the threaded tubular position and the coiled tubing position.

7. A rig as defined in claim 6, further comprising:

one or more fluid powered cylinders for moving the mast laterally.

8. A rig as defined in claim 6, wherein the injector is rigidly secured to the mast by a support bracket when in the threaded tubular position or the coiled tubing position.

9. A rig as defined in claim 1, wherein the mast is pivotable relative to the rig floor between the threaded tubular position and the coiled tubing position.

10. A rig as defined in claim 9, further comprising:

a stop for limiting pivoting of the mast when in the coiled tubing position.

11. A rig as defined in claim 9, further comprising:

one or more fluid powered cylinders for pivoting the mast between the threaded tubular position and the coiled tubing position.

12. A rig as defined in claim 9, wherein the injector is rigidly secured to the mast by a support bracket when in the threaded tubular position or the coiled tubing position, and the injector is pivotally secured to the mast when lowering the mast for rig travel.

13. A rig as defined in claim 9, further comprising:

a slide member for guiding vertical movement of the injector relative to the rig floor when the mast is in the coiled tubing position; and a drive member for selectively moving the coiled tubing injector vertically along the slide member.

14. A rig as defined in claim 1, wherein a rig table moves with the mast between the threaded tubular position and a coiled tubing position.

15. A rig as defined in claim 1, wherein the injector is positioned between the mast and a coiled tubing reel.

16. A rig as defined in claim 1, wherein the mast is mounted on a wheeled carrier.

17. A rig as defined in claim 1, further comprising:

a cutting unit for severing the coiled tubing above the rig floor.

18. A rig for selectively inserting coiled tubing or a threaded tubular through a rig floor and into a well, the rig comprising:

a mast extending upward from the rig floor and pivotally movable with respect to the rig floor between a threaded tubular position and a coiled tubing position;

a top drive movable along an axis of the mast to insert the threaded tubular in the well, the top drive having a top drive axis substantially aligned with an axis of a rig table when the mast is in the threaded tubular position;

an injector supported on the mast to insert the coiled tubing into the well, the injector having an injector axis offset from the top drive axis and substantially aligned with the axis of the rig table when the mast is in the coiled tubing position; and a powered drive for selectively moving the mast between the threaded tubular position and the coiled tubing position.

19. A rig as defined in claim 18, further comprising:

a stop for limiting pivoting of the mast when in the coiled tubing position.

20. A rig as defined in claim 18, wherein the injector is secured to the mast by a support bracket.

21. A rig as defined in claim 18, further comprising:

a slide member supported on the mast for guiding vertical movement of the injector relative to the rig floor when the mast is in the coiled tubing position; and a drive member for selectively moving the coiled tubing injector vertically along the slide member.

22. A rig as defined in claim 18, further comprising:

a coiled tubing guide above the injector for guiding the coiled tubing from a reel into the injector.

23. A rig as defined in claim 18, further comprising:

a lubricator extending downward from the injector for sealing an annulus about the coiled tubing.

24. A rig as defined in claim 18, further comprising:

a cutting unit for severing the coiled tubing above the rig floor.

25. A rig as defined in claim 18, wherein the top drive is moved longitudinally along the mast using a draw works.

26. A rig as defined in claim 18, further comprising:

one or more fluid powered cylinders for pivoting the mast between the threaded tubular position and the coiled tubing position.

27. A rig as defined in claim 23, wherein a rig table moves with the mast between the threaded tubular position and a coiled tubing position.

28. A rig for selectively inserting coiled tubing or a threaded tubular through a rig floor and into a well, the rig comprising:

a mast extending upward from the rig floor and movable between a threaded tubular position and a coiled tubing position;

a top drive movable along an axis of the mast to insert the threaded tubular in the well, the top drive having a top drive axis substantially aligned with an axis of the well when the mast is in the threaded tubular position;

an injector supported on the mast to insert the coiled tubing into the well, the injector having an injector axis offset from the top drive axis and substantially aligned with the axis of the well when the mast is in the coiled tubing position;

a guide rail for guiding lateral movement of the mast with respect to the rig floor between the threaded tubular position and the coiled tubing position; and one or more fluid powered cylinders for moving the mast laterally.

29. A rig as defined in claim 28, further comprising:

draw works for moving the top drive along the axis of the mast.

30. A rig as defined in claim 28, wherein the injector is rigidly secured to the mast by a support bracket when in the threaded tubular position or the coiled tubing position.

31. A method of selectively inserting coiled tubing or a threaded tubular through a rig floor and into a well, the method comprising:

providing a mast extending upward from the rig floor and movable between a threaded tubular position and a coiled tubing position;

moving a top drive along an axis of the mast to insert the threaded tubular in the well, the top drive having a top drive axis substantially aligned with an axis of the well when the mast is in the threaded tubular position;

supporting an injector on the mast to insert the coiled tubing into the well, the injector having an injector axis offset from the top drive axis and substantially aligned with the axis of the well when the mast is in the coiled tubing position; and selectively moving the mast between the threaded tubular position and the coiled tubing position.

32. A method as defined in claim 31, further comprising:

providing a coiled tubing guide above the injector for guiding the coiled tubing from a reel into the injector; and providing a lubricator extending downward from the injector for sealing an annulus about the coiled tubing.

33. A method as defined in claim 31, further comprising:

moving the top drive along the axis of the mast with a draw works.

34. A method as defined in claim 31, further comprising:

guiding movement of the mast laterally with respect to the rig floor between the threaded tubular position and the coiled tubing position.

35. A method as defined in claim 31, further comprising:

rigidly securing the injector to the mast by a support bracket when in the threaded tubular position or the coiled tubing position.

36. A method as defined in claim 31, further comprising:

pivoting the mast relative to the rig floor between the threaded tubular position and the coiled tubing position.

37. A method as defined in claim 36, further comprising:

providing a stop for limiting pivoting of the mast when in the coiled tubing position.

38. A method as defined in claim 31, further comprising:

guiding vertical movement of the injector relative to the rig floor when the mast is in the coiled tubing position; and powering a drive member to selectively move the coiled tubing injector vertically.

39. A method as defined in claim 31, further comprising:

moving a rig table and the mast between the threaded tubular position and a coiled tubing position.

* * * * *